US008687828B2

(12) United States Patent
Otani et al.

(10) Patent No.: US 8,687,828 B2
(45) Date of Patent: Apr. 1, 2014

(54) COVER UNIT COVERING OPENINGS AND AN ELECTRONIC DEVICE PROVIDED WITH THE COVER UNIT

(75) Inventors: Masayuki Otani, Daito (JP); Yoshiomi Kusunoki, Daito (JP)

(73) Assignee: KYOCERA Corporation, Kyoto (JP)

( * ) Notice: Subject to any disclaimer, the term of this patent is extended or adjusted under 35 U.S.C. 154(b) by 70 days.

(21) Appl. No.: 13/302,892

(22) Filed: Nov. 22, 2011

(65) Prior Publication Data

US 2012/0134518 A1 May 31, 2012

(30) Foreign Application Priority Data

Nov. 25, 2010 (JP) ..... 2010-262902

(51) Int. Cl.
*H04R 25/00* (2006.01)

(52) U.S. Cl.
USPC ..... 381/189; 181/149

(58) Field of Classification Search
USPC ..... 381/189, 300; 181/149, 175
See application file for complete search history.

(56) References Cited

U.S. PATENT DOCUMENTS

| | | | | |
|---|---|---|---|---|
| 7,957,541 | B2 * | 6/2011 | Edgren et al. | 381/89 |
| 2006/0159296 | A1 * | 7/2006 | Kobayashi et al. | 381/300 |
| 2010/0206660 | A1 * | 8/2010 | Horie et al. | 181/175 |
| 2011/0069855 | A1 | 3/2011 | Tokuda et al. | |

FOREIGN PATENT DOCUMENTS

| | | | |
|---|---|---|---|
| JP | H10-210121 | A | 8/1998 |
| JP | 2009-044731 | A | 2/2009 |
| JP | 2009-290466 | A | 12/2009 |
| JP | 2010-011340 | A | 1/2010 |

* cited by examiner

*Primary Examiner* — Quoc D Tran
*Assistant Examiner* — Joshua Kaufman
(74) *Attorney, Agent, or Firm* — Procopio, Cory, Hargreaves & Savitch LLP

(57) ABSTRACT

A cover unit that is provided to an electronic device as a waterproof cover, the cover unit covering one or more openings formed in a housing of the electronic device with respect to a plurality of speakers, and comprising a frame member having a plurality of windows disposed therein, the windows facing the speakers in one-to-one correspondence, and a waterproof film covering the windows. Having such a structure, the cover unit covers the one or more openings formed in the housing, and has an advantageous effect of suppressing at least one of (i) an increase in parts composing an electronic device and (ii) an increase in distortion of sound. Additionally, since a vibration unit faces a corresponding one of the speakers, the unnecessary vibration of the vibration unit is inhibited, which leads to a reduction in the distortion of sound.

9 Claims, 8 Drawing Sheets

COVER UNIT COVERING OPENINGS AND AN ELECTRONIC DEVICE PROVIDED WITH THE COVER UNIT

TECHNICAL FIELD

The present invention relates to a cover unit for covering openings which are formed in a housing of an electronic device for the purpose of enabling sound to pass therethrough, and in particular, to a technology of enabling transmission of sound to the outside of the housing of the electronic device while preventing entry of water into the housing.

DESCRIPTION OF THE RELATED ART

An electronic device, such as a mobile phone and a laptop computer, is commonly equipped with a speaker disposed within a housing thereof. Additionally, an opening is formed in the housing of such an electronic device, which allows sound waves generated by the speaker to pass through the housing. However, when such an opening is left uncovered, there is a risk of liquids, such as raindrops and beverages, making entry into the housing.

Patent Literature 1, Patent Literature 2, and Patent Literature 3 disclose a technology of preventing the entry of water into a housing of an electronic device by covering an opening formed in a portion of the housing facing a speaker or a microphone by using a waterproof membrane. In addition, Patent Literature 4 discloses a porous film that is applicable as such a waterproof membrane.

CITATION LIST

Patent Literature

[Patent Literature 1]
Japanese Patent Application Publication No. 10-210121
[Patent Literature 2]
Japanese Patent Application Publication No. 2010-11340
[Patent Literature 3]
Japanese Patent Application Publication No. 2009-290466
[Patent Literature 4]
Japanese Patent Application Publication No. 2009-44731

SUMMARY OF INVENTION

Technical Problem

In electronic devices, there are cases where a plurality of speakers each having a comparatively small diameter are provided, instead of a single speaker with an enlarged diameter, in order as to ensure that sound is output at a sufficient volume. A plurality of speakers having small diameters are provided for several reasons including the following. Firstly, the enlargement of speaker diameter degrades the quality of an electronic device in terms of design. Secondly, there are cases where not enough space is available in an electronic device for providing a speaker having an enlarged diameter.

However, the provision of a plurality of speakers as described in the above and the forming, in the housing, of a plurality of openings which are in one-to-one correspondence with the plurality of speakers give rise to other problems. That is, when covering each of such openings separately, an inevitable increase in the number of parts composing the electronic device is brought about, which further leads to a rise in the manufacturing cost. Furthermore, the covering of a plurality of openings formed in the housing by using a single waterproof membrane gives rise to another problem. In such a case, the sound transmitted from the speakers via the waterproof membrane tends to be distorted. Furthermore, even in a case, for instance, where a single opening is formed in the housing with respect to a plurality of speakers, the sound transmitted from the speakers tends to be distorted when the opening is covered by using a waterproof membrane.

In view of the above-described problems, the present invention provides a cover unit, which is provided as a waterproof cover for one or more openings formed in a housing with respect to a plurality of speakers, and an electronic device provided with the cover unit having an advantageous effect of suppressing at least one of (i) an increase in parts composing an electronic device and (ii) an increase in distortion of sound.

Solution to the Problems

In view of the above-mentioned problems, the present invention provides a cover unit that is for an electronic device including: a housing having one or more openings formed therein; and a plurality of speakers disposed within the housing, the speakers facing the one or more openings, the cover unit preventing entry of water into the housing by covering the one or more openings and comprising: a frame member having a plurality of windows disposed therein, the windows facing the speakers in one-to-one correspondence; and a waterproof film covering the windows.

Advantageous Effects of the Invention

The cover unit pertaining to the present invention, when used as a waterproof cover for covering one or more openings that are formed in a housing of an electronic device with respect to a plurality of speakers, has an advantageous effect of suppressing at least one of (i) an increase in parts composing an electronic device and (ii) an increase in distortion of sound.

DESCRIPTION OF EMBODIMENTS

In the following, description is provided on an embodiment and a modification of the present invention with reference to the accompanying drawings.

[Embodiment]

<1. Structure of Portable Information Terminal>

1.1 Structure

Figure 1C:
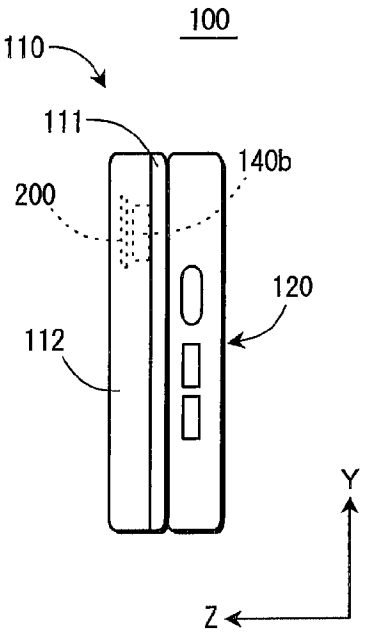
FIG. 1C is a lateral view of the portable information terminal 100 in the closed state thereof.
Figure 1B:
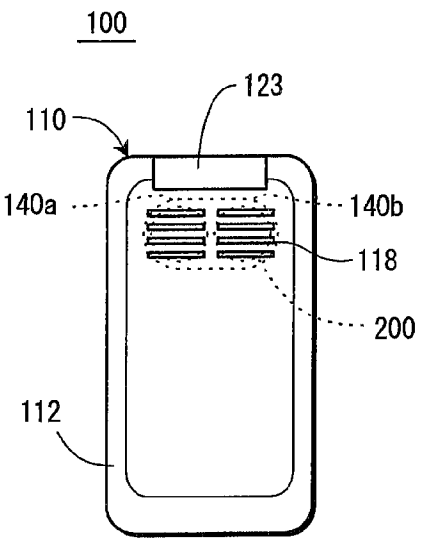
FIG. 1B is a plan view illustrating the portable information terminal 100 in a closed state thereof.
Figure 1A:
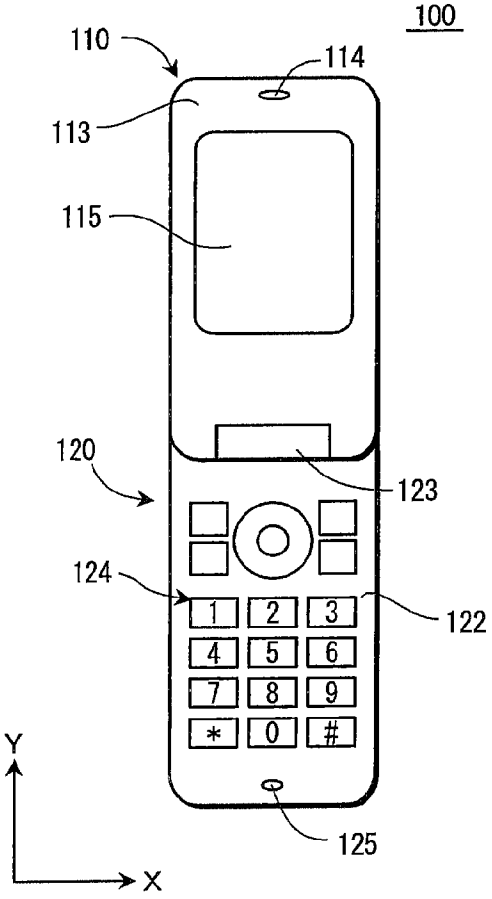
FIG. 1A is a plan view illustrating a portable information terminal 100 in an open state thereof.

FIGS. 1A, 1B, and 1C provide schematic illustrations of the exterior appearance of a portable information terminal 100 pertaining to an electronic device which is an embodiment of the present invention.

In the present embodiment, the portable information terminal 100 has the structure of a flip-type mobile phone. FIG. 1A and FIG. 1B respectively illustrate the portable information terminal 100 in an open state and a closed state. In addition, FIG. 1C is a lateral view of the portable information terminal 100 in the closed state (or in other words, in a folded state).

As illustrated in FIG. 1A, the portable information terminal 100 has a first housing 110 and a second housing 120. Each of the first housing 110 and the second housing 120 has a planar, rectangular shape, and is made of resin. In addition, each of the first housing 110 and the second housing 120 has a shape of a rectangle having a longer length in the vertical direction (the Y-axis direction in FIG. 1) and having a shorter length in the horizontal direction (the X-axis direction in FIG. 1).

The first housing 110 includes: a main housing body 111; and a protection cover 112 provided to a rear side of the main housing body 111. A receiver (voice receiving unit) 114 for outputting voices during phone calls and a display panel 115 composed of an LCD panel are arranged on a front side 113 of the main housing body 111. Here, note that the front side 113 is the side of the main housing body 111 that faces the second housing 120 when the portable information terminal 100 is in the folded state.

A joint unit 123, a user operation unit 124, and a microphone (voice transmitting unit) 125 are arranged on a front side 122 of the second housing 120. The joint unit 123 and a base end unit of the main housing body 111 together compose a hinge, which connects the main housing body 111 and the second housing 120 in a rotatable state. The user operation unit 124 has a plurality of control keys, a switch for inputting directions, and etc.

As illustrated in FIG. 1B, two circular speakers 140*a* and 140*b* both having the same structure are arranged on the rear side of the first housing 110. Each of the speakers 140*a* and 140*b* is a dynamic speaker, which includes a circular vibration plate (or a vibration film) and a housing accommodating the vibration plate. In a dynamic speaker, the vibration plate is caused to vibrate by magnetic force applied thereto. Additionally, the two circular speakers 140*a* and 140*b* are disposed within the main housing body 111 at a location where interference does not occur with the display panel 115. Note that, in the present embodiment, there are cases where no distinction is made between the two speakers 140*a* and 140*b*, and where reference is made thereto simply as speakers 140.

In addition, a plurality of slits 118 are formed in the protection cover 112. The slits 118 are disposed for the purpose of enabling sound waves output by the speakers 140 to pass therethrough.

Figure 2:
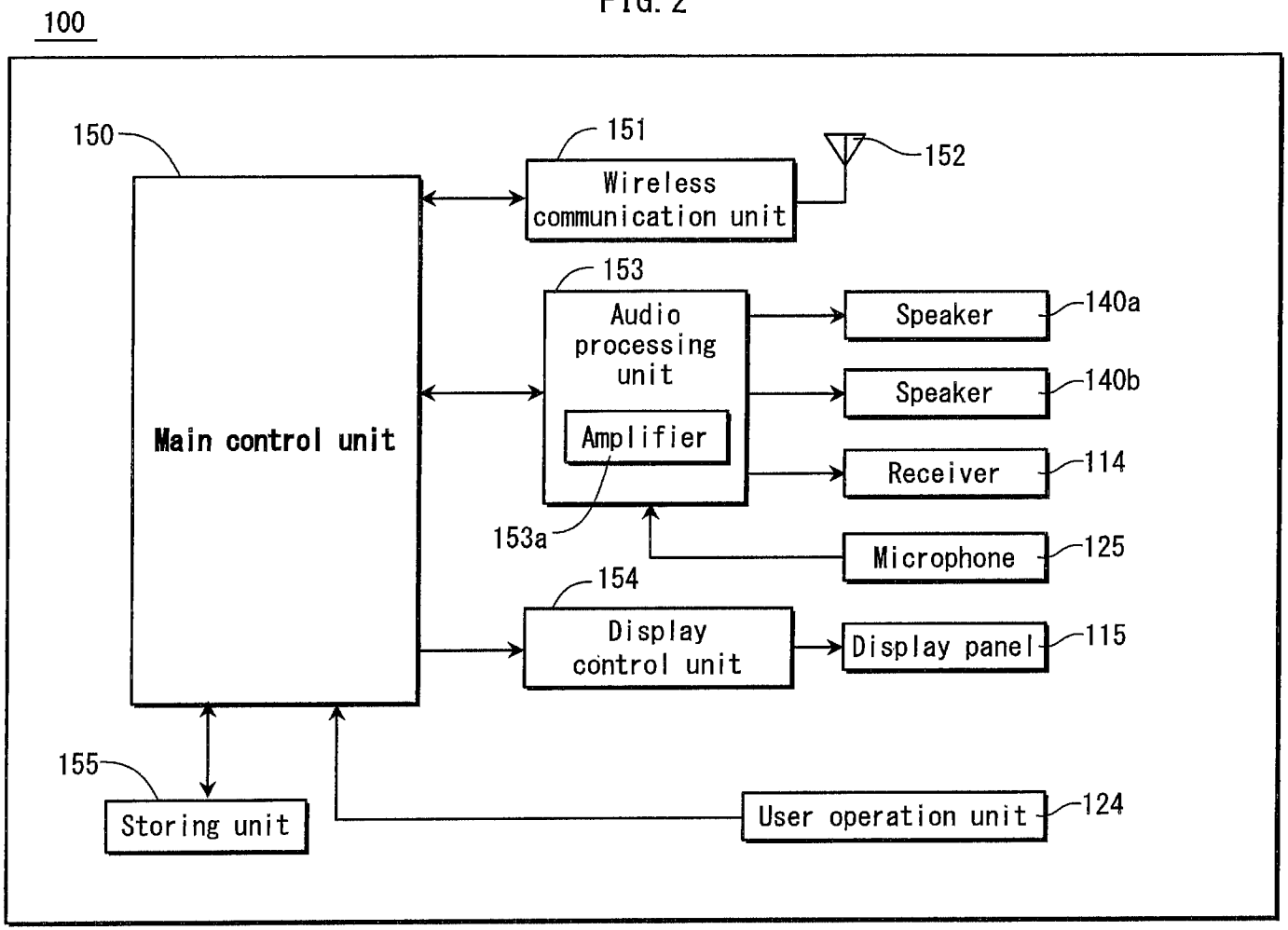
FIG. 2 is a block diagram illustrating a schematic structure of the portable information terminal 100.

FIG. 2 is a schematic block diagram which mainly illustrates an internal structure of the portable information terminal 100.

The portable information terminal 100 includes: a main control unit 150; a wireless communication unit 151; an audio processing unit 153; a display control unit 154; and a storing unit 155. Each of the wireless communication unit 151, the audio processing unit 153, the display control unit 154, and the storing unit 155 is connected to the main control unit 150.

The main control unit 150 includes a computer composed of a CPU (Central Processing Unit), a memory, a bus, and an I/O interface. The main control unit 150 causes the computer to execute various programs stored in the memory and the like, and thereby enables the mobile phone to perform various functions provided thereto, such as a voice communication function.

The wireless communication unit 151 performs transmission and reception of radio waves with a base station via an antenna 152. In addition, the wireless communication unit 151 has the functions of demodulating received signals, transmitting the demodulated signals to the main control unit 150, and modulating signals transmitted from the main control unit 150.

The audio processing unit 153 performs D/A conversion on audio signals transmitted from the main control unit 150, amplifies the converted audio signals by using an amplifier 153*a*, and outputs the amplified signals to the receiver 114 or the speakers 140. In addition, the audio processing unit 153 performs A/D conversion on voices input from the microphone 125, and outputs the converted signals to the main control unit 150.

The display control unit 154 causes the display panel 115 to display images transmitted from the main control unit 150.

The storing unit 155 includes a rewritable, non-volatile memory such as a flash memory, and stores ringtones, music data, and etc.

In addition, the user operation unit 124 is also connected to the main control unit 150.

Figure 3B:
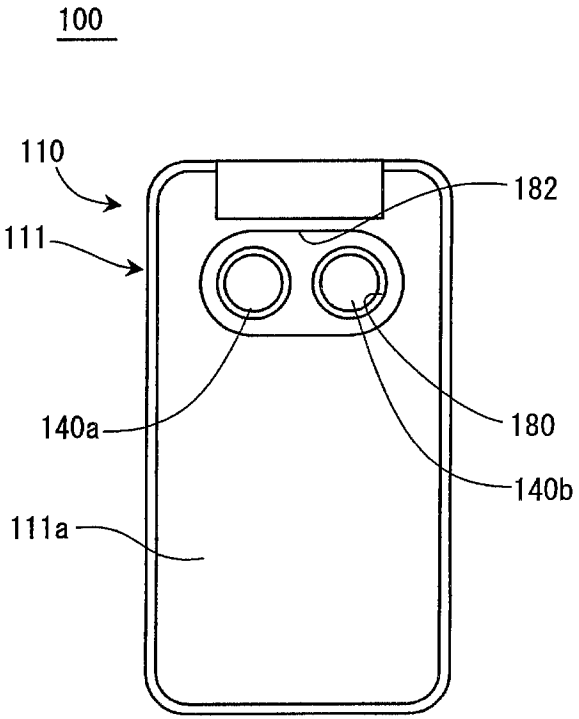
FIG. 3B is a rear view of the portable information terminal 100 not having the cover unit 200 attached thereto.
Figure 3A:
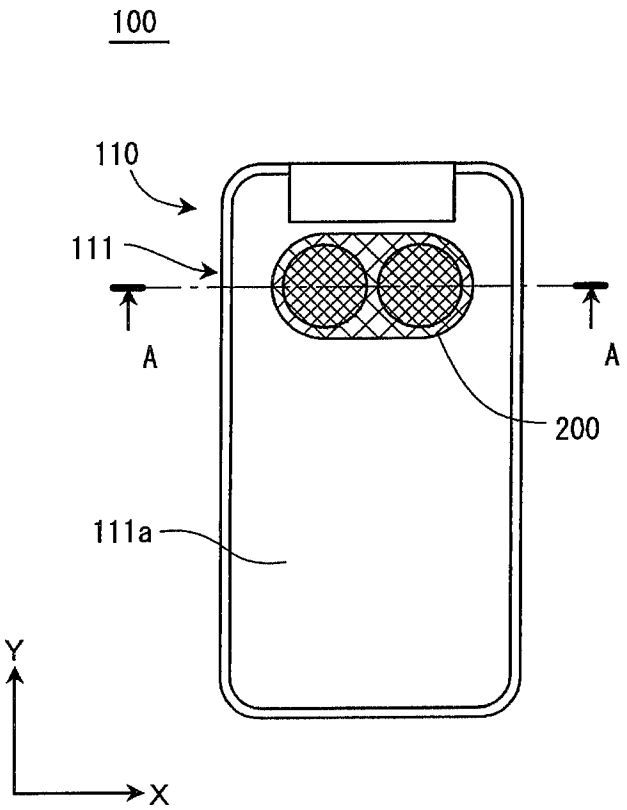
FIG. 3A is a rear view of the portable information terminal 100 having a cover unit 200 attached thereto.

FIGS. 3A and 3B illustrate the rear side of the main housing body 111. Note that FIGS. 3A and 3B illustrate the main housing body 112 not having the protection cover 112 attached thereto.

As illustrated in FIG. 3A, a rear side 111*a* of the main housing body 111 is provided with a cover unit 200. The cover unit 200 prevents water from entering the main housing body 111. Note that the cross-hatch pattern (mesh pattern) in FIG. 3A is illustrated for the sake of making the illustration easier to see, and does not indicate that a cross-section of the cover unit 200 is being illustrated.

FIG. 3B illustrates the main housing body 111 not having the cover unit 200 attached thereto. In the rear side 111*a* of the main housing body 111, circular openings 180*a* and 180*b* are respectively formed in front of the two speakers 140*a* and 140*b*. In other words, each of the openings 180*a* and 180*b* is formed in a location of the main housing body 111 facing the corresponding one of the speakers 140*a* and 140*b*. Note that, in FIG. 3B, the vibration plates of the speakers 140 are illustrated.

In addition, in the rear side 111*a* of the main housing body 111, a concavity 182 having the shape of an elongated circle is formed. The concavity 182 is provided for receiving the cover unit 200. Here, note that the elongated circular shape may be referred to as a rounded rectangle, and can also be expressed as a shape of a rectangle sandwiched by two semicircles.

1.2 Details of the Cover Unit

Figure 4A:
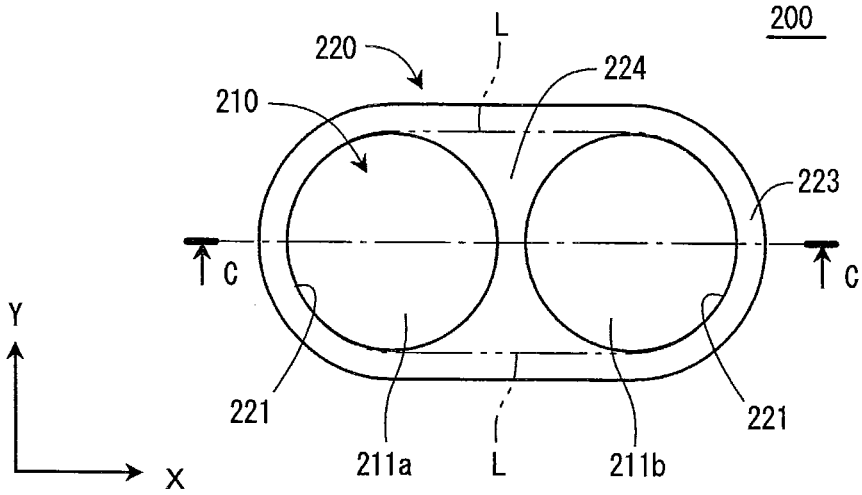
FIG. 4A is a plan view illustrating the cover unit 200.
Figure 4B:
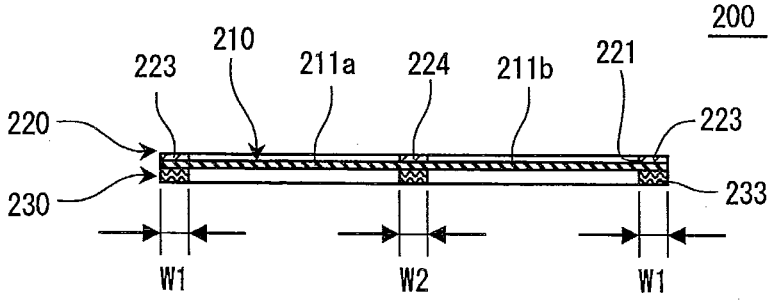
FIG. 4B is a cross-sectional view taken along line C-C in FIG. 4A.
Figure 4C:
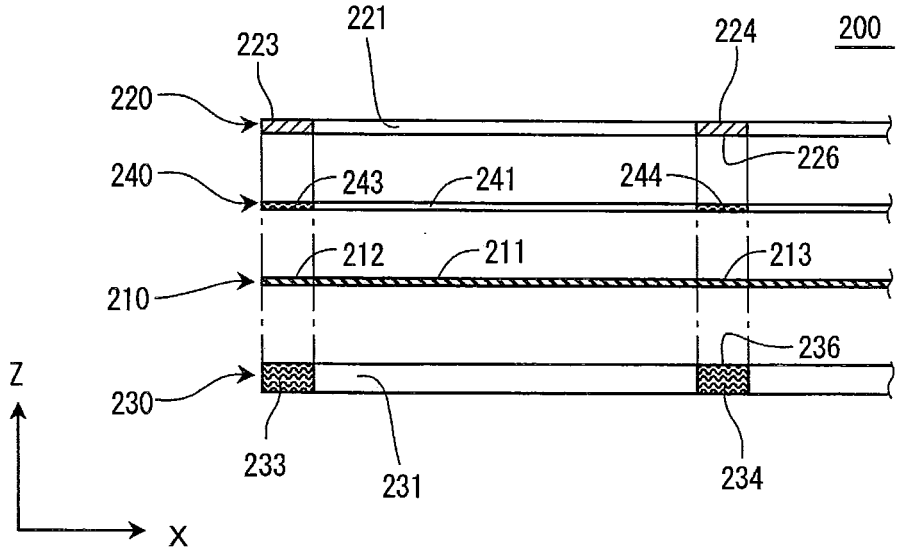
FIG. 4C is an exploded view of the cover unit 200.
Figure 5A:
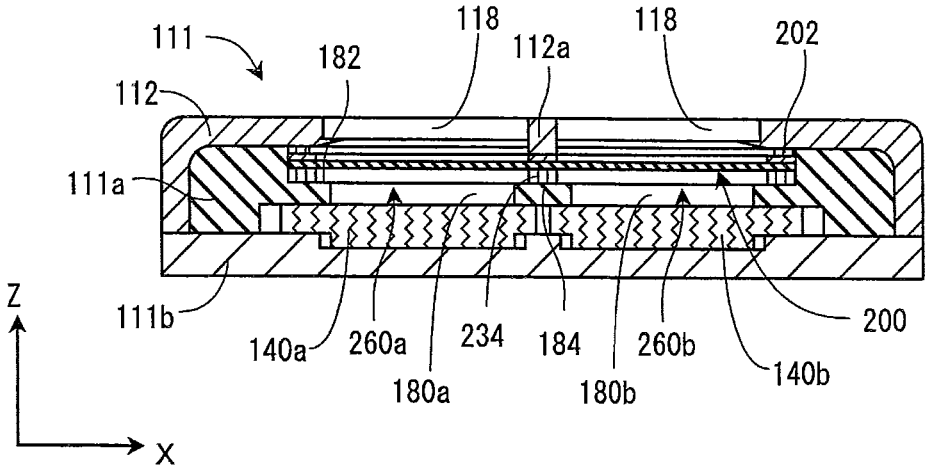
FIG. 5A is a cross-sectional view taken along line A-A in FIG. 3A.
Figure 5B:
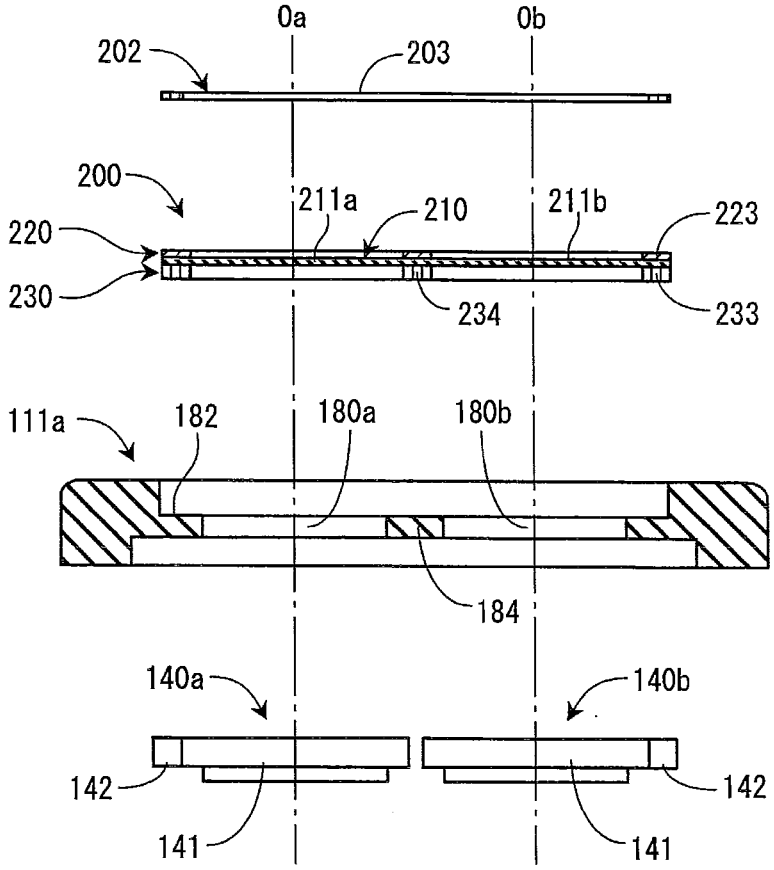
FIG. 5B is a cross-sectional diagram illustrating the main components illustrated in FIG. 5A in a dismantled state.

FIG. 4A is a plan view illustrating the cover unit 200, FIG. 4B is a cross-sectional view taken along line C-C in FIG. 4A, and FIG. 4C is an exploded view (cross-section) of the cover unit 200. FIG. 5A is a cross-sectional view taken along line A-A in FIG. 3A. Further, FIG. 5B is a cross-sectional view illustrating the main components introduced in FIG. 5A in a dismantled state.

As illustrated in FIGS. 4A, 4B, and 4C, the cover unit 200 includes: a waterproof film 210; a frame member 220; and a double-sided adhesive film 230. In addition, although not depicted in FIG. 4B, a thin, double-sided adhesive film 240 provides adhesion between the waterproof film 210 and the frame member 220 as illustrated in FIG. 4C.

The waterproof film 210 has an external shape (or an outline) of an elongated circular shape in plan view. The waterproof film 210 is composed of a porous film of polytetrafluoroethylene (PTFE), which has a plurality of microscopic holes formed therein. Further, the waterproof film 210 is water-resistant, at the same time as allowing permeation of moisture. In addition, the waterproof film 210 is sufficiently elastic, and functions as a vibration film which performs secondary vibration.

The frame member 220 is planar, and has two circular windows 221 formed therein. In plan view, the frame member 220 has an outline of an elongated circular shape, which is the same as the outline of the waterproof film 210.

Further, the frame member 220 has an outer frame 223 which has an elongated circular shape and a partition 224. The partition 224 partitions an area of the frame member 220 which is surrounded by the outer frame 223. Each of the two windows 221 is surrounded by the outer frame 223 and the partition 224. More specifically, the partition 224 is an area which is surrounded by the two windows 221 and two parallel lines L that are commonly tangent to the two windows 221. In addition, the outer frame 223 is defined as an annular portion (a portion having an elongated circular shape) which surrounds the two windows 221 and the partition 224. Here, note that the frame member 220 is formed of a single member, and thus, the outer frame 223 and the partition 224 are continuous.

A surface of the frame member 220 that faces the waterproof film 210 is an adhesive surface 226, and the adhesive surface 226 is adhered to the waterproof film 210 via the double-sided adhesive film 240.

Here, it is to be noted that the frame member 220, the double-sided adhesive film 230, and the double-sided adhesive film 240 are equivalent to each other in shape and in size in plan view. Further, the double-sided adhesive film 230 and the double-sided adhesive film 240 are layered with respect to the frame member 220 such that the outlines thereof coincide with the outline of the frame member 220 and the portions thereof corresponding to the windows 221 coincide with the windows 221 of the frame member 220 in plan view. In addition, it is also to be noted that the outline of the frame member 220 coincides with the outline of the waterproof film 210 in plan view.

As such, similar to the frame member 220, the double-sided adhesive film 230 includes: windows 231; an outer frame 233; and a partition 234; and the double-sided adhesive film 240 includes: windows 241; an outer frame 243; and a partition 244.

Among portions of the waterproof film 210, portions which are not adhered to the frame member 220, or in other words, portions which cover the windows 221*a* and 221*b* of the frame member 220 are defined as vibration units 211 (also to be referred to hereinafter as "vibration films") Further, a rim portion 212 of the waterproof film 210 is fixed to the outer frame 223 by adhesion thereto, and a boundary portion 213, which is a boundary area between the two vibration units 211, is fixed to the partition 224 by adhesion thereto.

As such, the two vibration units 211 of the waterproof film 210 vibrate by receiving sound waves produced by the speakers 140. On the other hand, vibration of the rim portion 212 and the boundary portion 213 of the waterproof film 210 is inhibited by being fixed to the frame member 220. Additionally, since the waterproof film 210 is adhered to the rear side 111*a* (more specifically, to a bottom surface of the concavity 182) of the main housing body 111 via the double-sided adhesive film 230, vibration of the rim portion 212 and the boundary portion 213 does not readily occur.

Note that, the frame member 220 is composed of, for instance PET (Polyethylene terephthalate), and thus, is much stronger compared to the waterproof film 210. Thus, vibration of the frame member 220 does not readily occur.

Here, an adhesion width W1 at the outer frame 223 and an adhesion width W2 at the partition 224 are equivalent in length. In consequence, a reduction of the size of the cover unit in the vertical direction (X-axis direction) is realized (refer to FIG. 6A, where a comparative example is illustrated), while a sufficient adhesion width (width of surface where contact is made) is secured between the frame member 220 and the waterproof film 210. Note that here, the adhesion width W1 corresponds to the length of the outer frame 223 of the frame member 220 in a diametrical direction of the windows 221. More specifically, the diametrical direction can be defined as a direction parallel to a line passing through the two centers of the two windows 221 in plan view. Further, the adhesion width W2 is an adhesion width at a point where the two windows 221 are closest to each other, and thus, corresponds to a minimum value of the distance between the two windows 221. In addition, the adhesion width W2 can be set within a range between equal to or greater than 100% of the adhesion width W1 and smaller than 200% of the adhesion width W1.

As already mentioned in the above, the frame member 220, the double-sided adhesive film 230, and the double-sided adhesive film 240 are equivalent to each other in shape and size in plan view. Further, the double-sided adhesive film 230 and the double-sided adhesive film 240 are adhered such that the outlines thereof coincide with the outline of the frame member 220 and such that the portions thereof corresponding to the windows 221 coincide with the windows 221 of the frame member 220. As such, the cover unit 200 can be adhered onto the main housing body 111 while pressing the frame member 220. Thus, sufficient adhesion between the cover unit 200 and the main housing body 111 is ensured while avoiding the risk of damaging the waterproof film 210. Additionally, the rim portion 212 and the boundary portion 213 of the waterproof film 210 are firmly fixed to the corresponding portions of the frame member 220, while the vibration units 211 are each provided with a sufficient surface area.

1.3 Arrangement of the Speakers, and the Periphery of the Speakers

As illustrated in FIG. 5A, the cover unit 200 is adhered onto the bottom surface of the concavity 182 of the rear side 111*a* of the housing via the double-sided adhesive film 230, and is thereby attached to the main housing body 111. In addition, the frame member 220 of the cover unit 200 is adhered onto the protection cover 112 via a double-sided adhesive film 202 having an elongated circular shape. More specifically, the double-sided adhesive film 202 has an annular shape and has an opening 203 having an elongated circular shape formed therein. In addition, the protection cover 112 is provided with a pressing portion 112*a*, which presses against the partition 224 of the frame member 220.

The two speakers 140*a* and 140*b* are accommodated in the main housing body 111. More specifically, the speakers 140 are disposed in a space surrounded by a front side 111*b* of the housing and the rear side 111*a* of the housing. Further, the two speakers 140*a* and 140*b* are arranged next to each other with the front sides thereof facing the rear side 111*a* of the housing. That is, the two speakers 140*a* and 140*b* are disposed side-by-side. Further, the speakers 140*a* and 140*b* are arranged such that the front sides thereof are at a same height in the Z-axis direction illustrated in FIG. 5A.

Additionally, the two speakers 140*a* and 140*b* are respectively arranged to face an opening 180*a* and an opening 180*b*, and the outer circumferences of the front surfaces thereof are in close contact with the rear side 111*a* of the housing. More specifically, a rim of an opening in a housing of each of the speakers 140 is put in close contact with the rear side 111*a* of the housing, while surrounding the corresponding one of the openings 180*a* and 180*b*.

As a result, a space 260*a* which is surrounded by the speaker 140*a*, the cover unit 200, and walls of the opening 180*a* is formed facing the front side of the speaker 140*a*. Similarly, a space 260*b* which is surrounded by the speaker 140*b*, the cover unit 200, and walls of the opening 180*b* is formed facing the front side of the speaker 140*b*. Note that the space 260*a* and the space 260*b* as introduced in the above are separated from each other, by a partition 184 of the rear side 111*a* of the housing and the partition 234 of the double-sided adhesive film 230.

Here, it is to be noted that the distance between the speaker 140*a* and the vibration unit 211*a* of the cover unit 200 and the distance between the speaker 140*b* and the vibration unit 211*b* of the cover unit 200 are arranged to be equivalent.

Further, as illustrated in FIG. 5B, the center of the window 221*a* and the center of the opening 180*a* are located substantially along a center line Oa extending from the center of the speaker 140*a*. Similarly, the center of the window 221*b* and the center of the opening 180*b* are located substantially along a center line Ob extending from the center of the speaker 140*b*.

The two windows 221*a* and 221*b* of the frame member 220 respectively have a larger external size than the openings 180*a* and 180*b*. As such, the cover unit 200 is disposed such that each of the vibration units 211 covers the corresponding one of the openings 180*a* and 180*b* and the double-sided adhesive film 230 surrounds the openings 180*a* and 180*b*. Further, since the windows 221 of the frame member 220 are covered by the waterproof film 210, the openings 180*a* and 180*b* are covered by the cover unit 200. Hence, the cover unit 200 prevents the entry of water into the housing from the openings 180*a* and 180*b*. Note that here, the cover unit 200 need not be perfectly water resistant. That is, for instance, the cover unit 200 may be practically water resistant under daily conditions, or may be water resistant to a degree satisfying the requirements of JIS level I (waterproof type I) or JIS level II (JIS C 0920).

In the present embodiment, the outer diameter of each of the speakers 140 is set to Φ15 mm, the diameter of each of the windows 221 is set to Φ14 mm, the diameter of each of the openings 180*a* and 180*b* is set to Φ12 mm. Each of the components of the cover unit 200 is provided with a thickness as described in the following. The waterproof film 210 has a thickness of approximately 0.01 mm, the frame member 220 has a thickness of approximately 0.1 mm, the double-sided adhesive film 230 has a thickness of approximately 0.25 mm, and the double-sided adhesive film 240 has a thickness of approximately 0.05 mm. Further, the distance between the vibration units 211 of the waterproof film 210 and the corresponding speakers 140, and the distance between the vibration units 211 and the protection cover 112 are commonly set to greater than or equal to 0.5 mm.

Note that the diameter of each of the windows 221 may be set between 70% to 110%, or between 80% to 100%, of the outer diameter of the speakers 140. Additionally, the diameter of each of the openings 180*a* and 180*b* may be set between 50% to 90%, or between 60% to 80%, of the outer diameter of the speakers 140.

The adhesion width W1 and the adhesion width W2 may each be set between 1 mm to 4 mm. In the present embodiment, the adhesion width W1 and the adhesion width W2 are commonly set to 2 mm.

1.4 Manufacturing Method of the Cover Unit 200

In the following, a brief explanation is provided of an example of a manufacturing method of the cover unit 200. Note that in the explanation provided in the following, a surface closer to the frame member 220 in the lamination direction of the cover unit 200 is referred to as an upper surface (or as a first surface, a first adhesive surface, and etc.) while a surface closer to the double-sided adhesive film 230 in the lamination direction of the cover unit 200 is referred to as a lower surface (or as a second surface, a second adhesive surface, and etc.).

Multiple circular holes (which correspond to the windows 231) are formed in the double-sided adhesive film 230 adhered onto a mount (either a sheet of paper or resin) that can be easily delaminated. Here, care should be taken so as not to form such circular holes in the mount. Subsequently, an upper surface (a first adhesive surface) of the double-sided adhesive film 230 is adhered onto a lower surface (a second surface) of the waterproof film 210.

In addition, a first adhesive surface of the double-sided adhesive film 240 is adhered onto a flat plate of PET, from which the frame member 220 is to be formed. Subsequently, multiple circular holes (which correspond to the windows 221 and the windows 241) are formed in the flat plate of PET and the double-sided adhesive film 240 by punching or the like.

Following this, a lower surface (a second adhesive surface) of the double-sided adhesive film 240 is adhered onto an upper surface (a first surface) of the waterproof film 210. Here, adhesion is performed such that the positions of the holes formed in the flat plate of PET and the positions of the holes formed in the double-sided adhesive film 230 coincide with each other in plan view.

Finally, the manufacturing of the cover unit 200 is completed by punching out an elongated circular member surrounding two holes (which correspond to the windows 221 and the like). Here, by ensuring that elongated circular holes corresponding to the elongated circular members that are to be punched out are not formed in the mount, the mount will be in a state where multiple cover units 200 are adhered thereto.

Alternatively, by punching out elongated circular portions of the mount along with the cover units 200, each of the cover units 200 may have a portion of the mount remaining adhered thereto.

<2. Operations>

2.1 Usage of the Speakers 140

The speakers 140 are used during playback of ringtones or music and during a "hands-free speaker call". Note that here, the term "hands-free speaker call" refers to a call where a user makes a call by listening to the voice output from the speakers 140, with the portable information terminal 100 in a certain distance from his/her ear. Thus, during a hands-free speaker call, the receiver 114 is not used.

During the playback of ringtones or music, music data stored in the storing unit 155 are transmitted to the audio processing unit 153, where the music data are converted into audio signals. Subsequently, the audio signals are amplified, and then are output to the speakers 140.

During hands-free speaker calls, audio signals received by the wireless communication unit 151 are transmitted to the audio processing unit 153, where amplification and the like of the audio signals are performed. The audio signals are then output to the speakers 140.

Note that in the present embodiment, the audio processing unit 153 outputs, to the two speakers connected to the amplifier 153*a* (which is an example of an audio amplifier), the same monophonic signals. Hence, the two speakers 140 are caused to generate sound waves having a same amplitude and phase.

2.2 Transmission of Sound by the Cover Unit

In addition to the function of preventing the entry of water into the housing of the portable information terminal 100 by covering the openings 180*a* and 180*b*, the cover unit 200 also has a function of transmitting sound waves output from the speakers 140 to outside the housing.

As illustrated in FIG. 5B, each of the vibration units 211 of the cover unit 200 is disposed so as to face the corresponding one of the speakers 140. In specific, a normal line with respect to each of the vibration units 211 is arranged to be substantially parallel with a center axis line of the corresponding one of the speakers 140, and at the same time, a center of each of the vibration units 211 (or a center of each of the corresponding windows 221) is arranged in the substantially same position as a center of the corresponding one of the speakers 140 in plan view.

Thus, sound waves output from the speaker 140*a* illustrated in the left side of the image mainly arrive at the vibration unit 211*a*, which is similarly in the left side of the image, for example. As a result, the vibration unit 211*a* is caused to vibrate. Similarly, sound waves output from the speaker 140*b* illustrated in the right side of the image mainly arrive at the vibration unit 211*b*, which is similarly in the right side of the image, and thus, the vibration unit 211*b* is caused to vibrate. As a result, the sound waves output from the speakers 140 are transmitted to outside the main housing body 111 via the vibration units 211. Note that here, the boundary portion 213 between the two vibration units 211 is adhered to and thus fixed to the partition 224 of the frame member 220 and the partition 234 of the double-sided adhesive film 230. Therefore, the boundary portion 213 does not vibrate, even when exposed to sound waves output from the speakers 140.

Further, and as already has been mentioned in the above, the spaces 260*a* and 260*b* which are respectively formed in front of the speakers 140*a* and 140*b* are separated from each other. As such, sound waves generated by each of the speakers 140*a* and 140*b* travel through a corresponding one of the spaces 260*a* and 260*b*, and thereby vibrate a corresponding one of the vibration units 211*a* and 211*b*. As such, since each of the vibration units 211 does not receive sound waves output from the other one of the speakers 140 which does not correspond thereto, the generation of unnecessary vibrations is suppressed, and further, the increase of distortion in sound is inhibited. Note that in the above, the expression "the other one of the speakers 140 which does not correspond thereto" refers to the speaker 140*b* in the case of the vibration unit 211*a* and refers to the speaker 140*a* in the case of the vibration unit 211*b*.

<3. Comparison with Comparative Example>

Figure 6A:
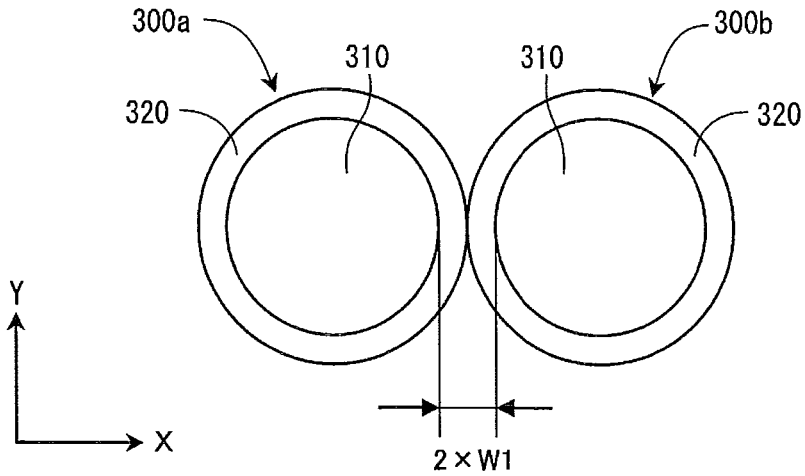
FIG. 6A is a plan view illustrating two cover units 300.
Figure 6B:
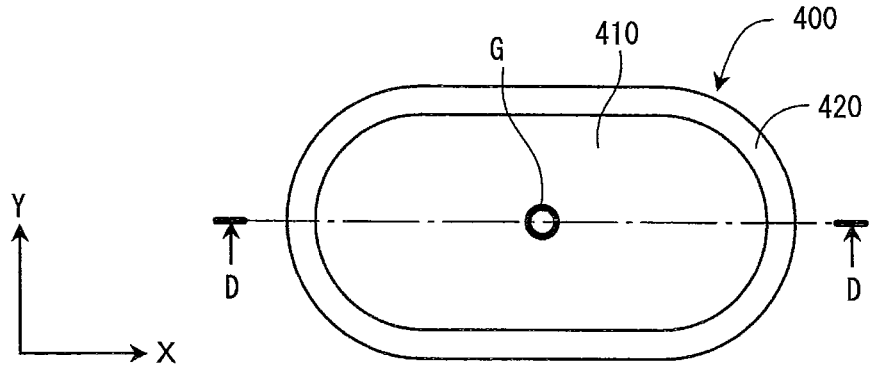
FIG. 6B is a plan view illustrating a cover unit 400 having one vibration unit 411 formed therein.
Figure 6C:
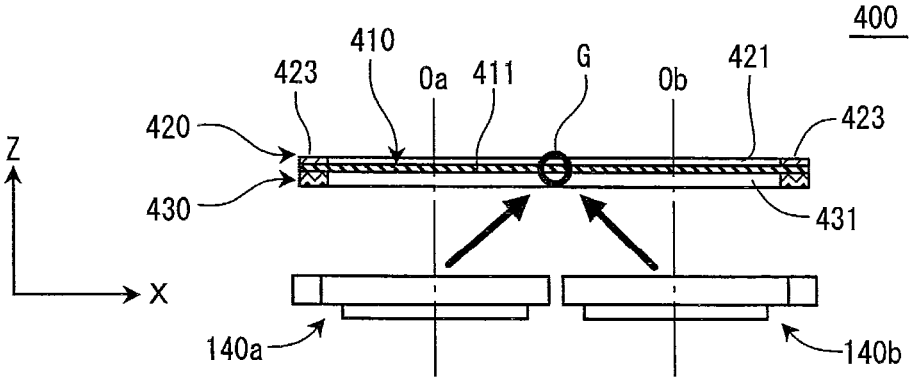
FIG. 6C is a cross-sectional view taken along line D-D in FIG. 6B.

FIGS. 6A-6C illustrate examples for comparison with the cover unit 200.

FIG. 6A is a plan view illustrating two cover units 300. FIG. 6B is a plan view of a cover unit 400 having a single vibration unit 411, and FIG. 6C is a cross-sectional view taken along line D-D in FIG. 6B.

3.1 Comparison with the Two Cover Units 300

When openings formed in the housing are covered by using the two cover units 300, an increase is brought about in the total length in the X-axis direction. More specifically, the total length occupied by the two cover units 300 in the X-axis direction exceeds the length of the cover unit 200 in the X-axis direction. Such an increase in length in the X-axis direction is brought about since there is a need of providing an adhesion width W1 to the rim portion 212 of each of waterproof films 310 for adhesion with frame members 320. In contrast to this, in the case of the cover unit 200, since the two windows 221 are covered by the single waterproof film 210, the adhesion width between the two vibration units 211 are shared. In specific, in the case of the cover unit 200, the adhesion width between the two windows 221 is smaller than the distance (2×W1) between the two windows 310 of the two cover units 300. As a result, the length of the cover unit 200 in the direction of a line connecting the centers of the two windows 221 is shortened compared to the case of the two cover units 300. As such, the cover unit 200 can be disposed in a comparatively small space while maintaining a sufficient adhesion width.

3.2 Comparison with a Cover Unit 400 Having One Vibration Unit

In a cover unit 400 illustrated in FIGS. 6B and 6C, a single vibration unit 411 is formed with respect to the two speakers 140. Such a structure is problematic in that an obvious increase of distortion in sound is brought about, including the generation of noises caused by abnormal vibration. The reason for which distortion in sound increases is assumed to be as described in the following.

A vibration unit 411 of the cover unit 400 has an elongated circular shape and not a circular shape, and thus, the distance from the center of the vibration unit 411 to the frame member 220 differs according to portions thereof. As such, it can be assumed that distortion of sound is brought about by vibrations with frequencies not included in the sound output from the speakers 140 being generated by the vibration unit 411.

Note that, although a countermeasure may be taken of providing a vibration unit (window) having an outline of a large circle enclosing the two openings 180*a* and 180*b*, the size of the cover unit will be enlarged by a great extent, which is problematic.

Further, the distortion of sound can be brought about for another reason. In plan view, a center portion G of the vibration unit 411 is arranged to be in a same distance from the two speakers 140. Thus, interference between the sound waves output from each of the two speakers 140 takes place at the center portion G. Additionally, it can be assumed that, in the periphery of the center portion G, areas exist where sound waves strengthen each other as well as areas where, contrarily, sound waves weaken each other. Such areas having different properties are created due to the difference in distance from the two speakers 140, and cause the vibration unit 411 to vibrate in a complex manner. As a result, it is assumed that localized vibrations occur at the center portion G, thereby causing the vibration unit 411 to vibrate disorderly.

Further, the distortion of sound may be brought about for yet another reason. The center portion G of the vibration unit 411 is distant from the central axis lines of the speakers 140.

On the other hand, the center portions of the two vibration units 211 of the cover unit 200 are arranged along the center axis lines of the speakers 140, and thus, are the closest portions of the two vibration units 211 with respect to the speakers 140, among the portions of the two vibration units 211. As such, it can be said that the center portion G of the vibration unit 411 is comparatively far from either one of the two speakers 140. Thus, a phase delay is observed between the sound waves arriving at the center portion G of the vibration unit 411 and the sound waves arriving at portions of the vibration unit 411 along the center axis lines of the speakers 140. This can be assumed as another reason why the vibration unit 411 vibrates in a disorderly manner.

Contrariwise, the cover unit 200 pertaining to the present embodiment is provided with the partition 224, which is located at a portion of the cover unit 200 corresponding to the center portion G of the cover unit 400. Thus, such localized vibrations as described in the above are not generated. Further, since the vibration units 211 are provided in one-to-one correspondence with the speakers 140, each facing a corresponding one of the speakers 140, it is assumed that disorderly vibrations are seldom generated.

3.3 Comparison with the Two Cover Units 300 Concerning Distortion Factor

Figure 7:
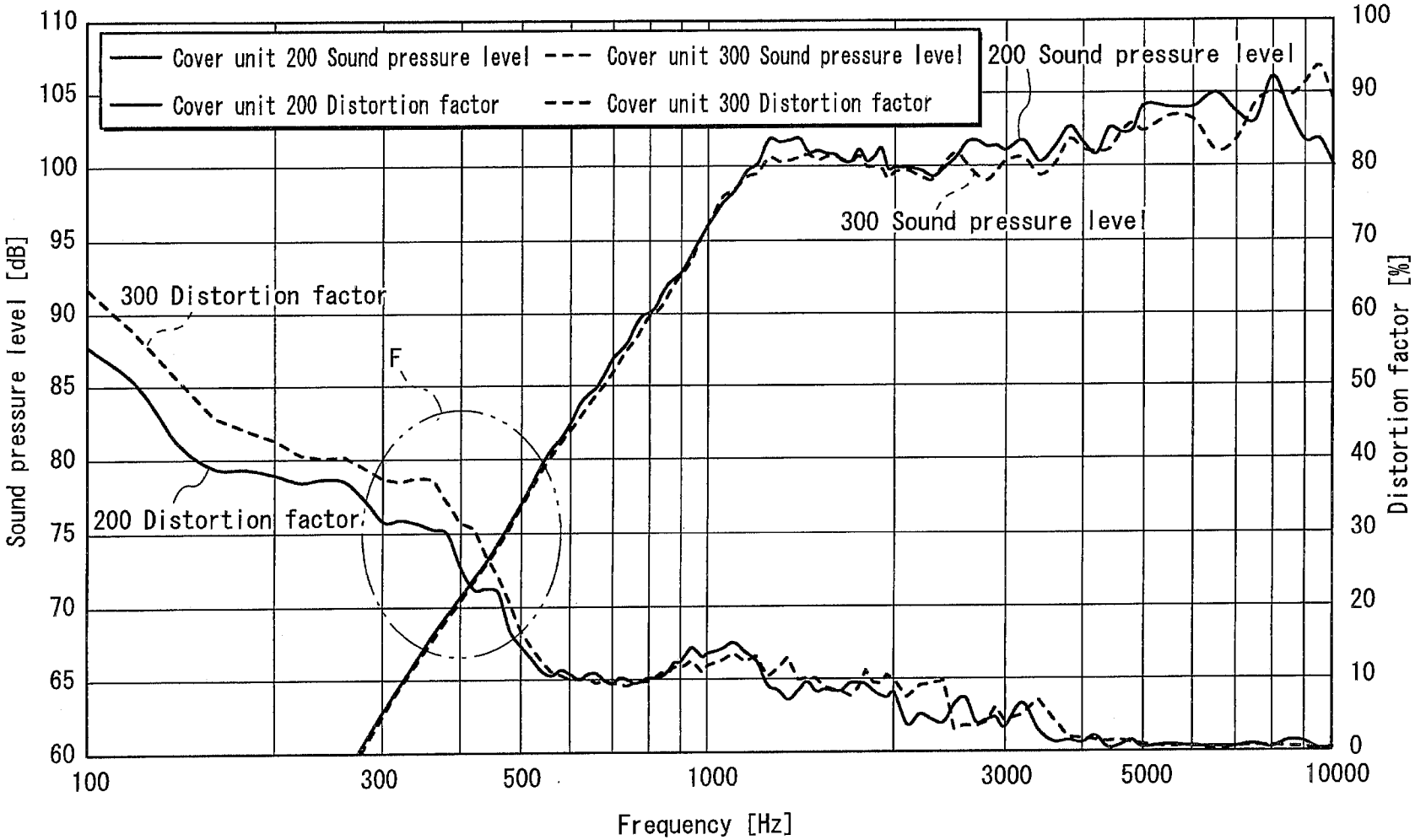
FIG. 7 is a graph showing a distortion factor of the portable information terminal 100.

FIG. 7 illustrates the distortion factor (total harmonic distortion ratio) in a case where the cover unit 200 pertaining to the present embodiment is provided to the portable information terminal 100 and the distortion factor (total harmonic distortion ratio) in a case where the two cover units 300 are provided to a portable information terminal. Further, for the sake of reference, indication is provided of the sound pressure level observed in each case.

Note that, in the measurement of the distortion factors and the sound pressure levels, a microphone was placed in a 10 cm-distance from the cover unit 200. Further, adjustment was performed of the distance between the center portions of the two speakers 140 and the distance between the two openings 180*a* and 180*b*. The adjustment was performed taking into account the difference in the distance between the centers of the two vibration units 211 of the cover unit 200 and the distance between the centers of vibration units 311 of the two cover units 300.

The distortion factors illustrated in FIG. 7 have been obtained by using the following formula:

$$THD=[(V_2^2+V_3^2+V_4^2+\ldots+V_n^2)^{\wedge}0.5]/V_1 \qquad \text{Formula (1).}$$

In Formula (1), $V_1$ denotes an effective voltage of a signal (sine wave signal) input to the speakers 140, and $V_2$, $V_3$, . . . $V_n$ denote effective voltages of a harmonic component of a frequency that is an integer multiple of a frequency of the input signal.

As illustrated in circle F in FIG. 7, the distortion factor of the cover unit 200 is lower than the distortion factor of the two cover units 300 by around 5% between a frequency range of 300 Hz-500 Hz. As such, it has been observed that, by using the cover unit 200, the distortion factor in a case where a male voice is amplified during a hands-free speaker call is reduced.

Although the exact reason as to why the distortion factor is reduced by using the cover unit 200 is not clear, assumption can be made as described in the following. In the cover unit 200, each of portions of the frame member 220 surrounding the windows 221 and portions of the double-sided adhesive film 230 surrounding the windows 231 are provided in a continuous manner. Thus, assumption is made that an effect of reinforcing the strength of the housing is enhanced by the continuity of such portions, thereby inhibiting unnecessary and undesired vibration of the housing.

Furthermore, in recent years, the housings of electronic devices such as portable information terminals are manufactured so as to have as thin a plate thickness as possible in order as to provide electronic devices that are light and compact. The reduction of plate thickness of the housings is performed while ensuring that the housing has a sufficient level of strength. However, as a result of such thinning, it can be assumed that the strength at portions of the housing in which openings are formed is impaired, and that such portions readily vibrate when exposed to the sound waves produced from the speakers 140.

Further, in the present embodiment, an area between the two windows 221 arranged side by side in the frame member 220 and an area between the two windows 231 arranged side by side in the double-sided adhesive film 230 are comparatively large. More specifically, the partition 224 of the frame member 220 is formed in an area between the two lines L commonly tangent to the two windows 221, which are arranged side by side, and the partition 234 of the double-sided adhesive film 230 is foamed in an area between the two lines L commonly tangent to the two windows 231, which are arranged side by side (refer to FIG. 4A). Further, an adhesion width is provided outside a range defined by the two lines L in each of the frame member 220 and the double-sided adhesive film 230. As such, the area in between the two windows 221 is excessively large when assumed to be provided merely for the sake of ensuring sufficient adhesion width. In fact, this large area between the two windows 221 has the advantageous effect of improving the strength of the cover unit 200, and improving the adhesion with the main housing body 111. As such, it is assumed that the area of the main housing body 111 where the openings 180*a* and 180*b* have been formed and which, as a result, has a degraded level of strength is effectively reinforced. As a result, unnecessary and undesirable vibrations are suppressed, and a reduced level of distortion in sound is realized.

<4. Other Advantageous Effects>

The improvement in strength of the cover unit 200 is also advantageous in that the risk of the cover unit 200 being damaged in the manufacturing process of the portable information terminal is reduced.

For instance, when a plurality of the cover units 200 are to be delivered in a state where the cover units are collectively adhered onto a mount, the manufacturing process involves a step of delaminating each of the cover units 200 from the mount. When assuming, for instance, that the area between the two windows 221 does not have a sufficient degree of strength, there is a risk of the cover unit being greatly deformed in the above-described step of delaminating the cover units from the mount. In such a case, the vibration units 211 of the cover unit will be crumpled, which may lead to the vibration units 211 being no longer usable. In short, such cover units are easily damaged.

In view of such a risk, the cover unit 200 pertaining to the present embodiment has an enhanced level of strength. Thus, the cover unit 200 is not readily damaged during the manufacturing process of the portable information terminal, and can be handled with ease.

[Modification]

In the embodiment above, two openings are formed in the housing with respect to the two speakers 140, but the present invention is not limited to this. The number of openings formed in the housing may be one. Since a portable information terminal 500 pertaining to the modification is similar to the portable information terminal 100 except for the shape of an opening 580 formed in a rear side 511*a* of a first housing 511, description is provided in the following focusing on differences between the portable information terminal 500 and the portable information terminal 100.

Figure 8A:
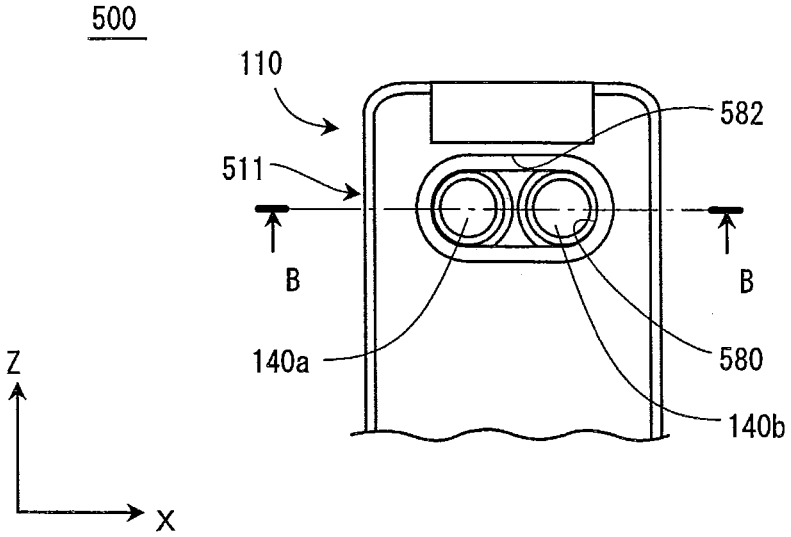
FIG. 8A is a plan view illustrating one part of a portable information terminal 500 pertaining to a modification of the present invention.
Figure 8B:
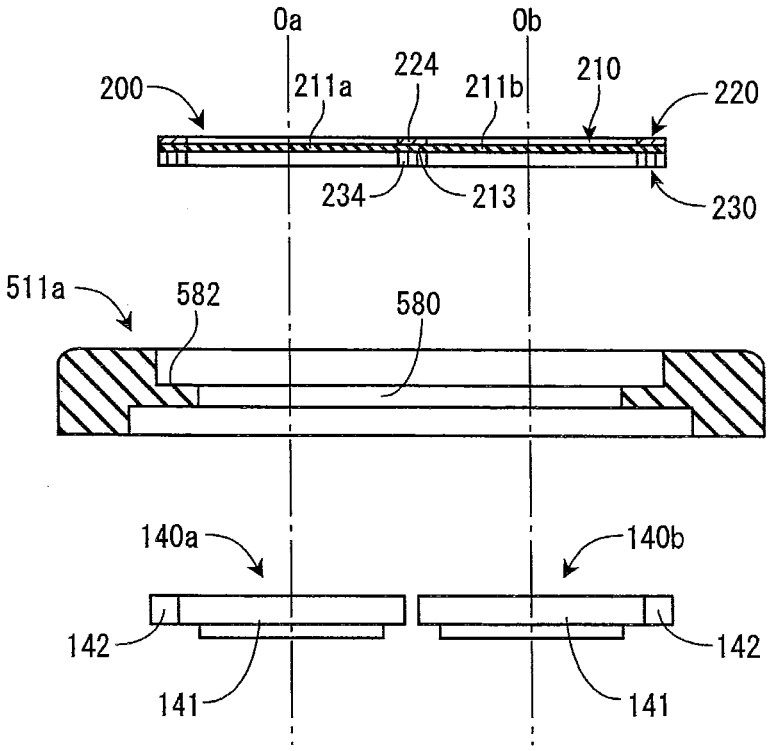
FIG. 8B is a cross-sectional view taken along line B-B in FIG. 8A.

FIG. 8A is a plan view illustrating a portion of the portable information terminal 500, and FIG. 8B is a cross-sectional view illustrating a portion of the portable information terminal 500.

The opening 580 has a similar shape as the cover unit 200, and is formed in a portion facing the speakers 140*a* and 140*b* of the rear side 511*a* of the housing. According to the present invention, even in such a case where one opening, namely the opening 580, is provided with respect to the two speakers 140, the increase of distortion in sound is suppressed and the entry of water into the first housing 511 is prevented.

Detailed explanation is provided hereinafter. In the cover unit 200, the undesirable vibration of the boundary portion 213 of the waterproof film 210 is prevented by the boundary portion 213 being fixed to the partition 224 of the frame member 220. Thus, the phenomenon occurring in the cases as illustrated in FIGS. 6B and 6C, where the center portion G of the vibration unit 411 having an elongated circular shape is vibrated by synthetic waves and the entirety of the vibration unit 411 accordingly vibrates in a disorderly manner, is suppressed. The synthetic waves as referred to here are generated as a result of sound waves transmitted from each of the speakers 140 being synthesized with each other.

Hence, each of the two vibration units 211*a* and 211*b* is caused to vibrate mainly by being exposed to sound waves produced by a corresponding one of the speakers 140*a* and 140*b*. Thus, the distortion factor of the cover unit 200 is reduced.

Note that, in order as to suppress the vibration of the boundary portion 213 of the waterproof film 210, arrangements may be made of providing the frame member 220 with a greater thickness and of providing two frame members 220.

[Supplementary Explanation]

(a) Although description has been provided in the above on the present invention with reference to an embodiment and a modification thereof, the present invention is not limited to such examples, and various changes and modifications are construed as being included in the scope of the present invention.

(b) In the embodiment, the cover unit 200 is provided with a single frame member 220. However, the present invention is not limited to this, and the number of frame members 220 provided to the cover unit 200 may be two. For instance, the cover unit 200 may have a structure where the waterproof film 210 is sandwiched between and thereby fixed to the two frame members 220.

(c) The double-sided adhesive film 230 need not be adhered onto the cover unit 200. That is, the double-sided adhesive film 230 may be provided to the main housing body 111 (more specifically, to the rear side 111*a* of the housing).

In addition, the frame member 220 of the cover unit 200 may be adhered onto the main housing body 111.

(d) The outline of the cover unit may be shapes other than the elongated circular shape described in the above, as long as the adhesion width surrounding the multiple windows is sufficient. For instance, the cover unit may have a polygonal shape or other various shapes.

(e) The frame member 220 and the waterproof film 210 may be fixed with respect to each other by means other than adhesion via a double-sided adhesive film. For instance, the frame member 220 and the waterproof film 210 may be adhered to each other by use of an adhesive agent, or the frame member 220 and the waterproof film 210 may be put into close contact with each other and thus fixed to each other by sandwiching the waterproof film 210 between two of the frame members 220 and fastening the two frame members 220 together.

(f) The waterproof film 210 is not limited to a porous film made of PTFE, and other films may be used as long as the film to be used is drip-resistant and vibrates to a suitable extent when exposed to sound waves. For instance, organic films such as polyethylene film, nylon film, and etc., or metallic films may be used as the waterproof film 210. Further, the waterproof film may be formed by laminating multiple films of different types. Further in addition, the waterproof film may be formed by using a porous film composed of a material other than PTFE.

(g) The material of the frame member is not limited to PET, and other materials may be used as long as the cover unit is provided with a sufficient degree of strength. For instance, the frame member may be formed by using organic materials such as resin having a comparatively high degree of strength, or inorganic materials such as metallic material and inorganic carbon.

(h) The vibration units 211 may be slightly loosened so as to yield a sufficient degree of vibration.

(i) Although description has been provided taking a dynamic speaker as an example in the embodiment and in the modification, the present invention is not limited to this. Alternatively, other speakers may be used, such as piezoelectric speakers and other types of speakers providing amplification of sounds and voices. However, it should be noted that in general, dynamic speakers are superior to other speakers in terms of sound quality.

(j) The cover unit may be used with respect to three or more speakers disposed in the housing. In such a case, the three speakers 140 and the windows 221 facing the speakers 140 are each to be disposed and arranged in series.

(k) In the description above, one opening is formed with respect to each of the two speakers 140. However, the present invention is not limited to this, and multiple openings with comparatively small diameters may be provided for each of the speakers 140. The provision of multiple openings for each of the speakers 140 may have the effect of suppressing the impairment of the strength of the housing.

(m) In the following, explanation is provided of the structure of and the effects brought about by various portable information terminals pertaining to the embodiment of the present invention.

(1) One aspect of the present invention is a cover unit that is for an electronic device including: a housing having one or more openings formed therein; and a plurality of speakers disposed within the housing, the speakers facing the one or more openings, the cover unit preventing entry of water into the housing by covering the one or more openings and comprising: a frame member having a plurality of windows disposed therein, the windows facing the speakers in one-to-one correspondence; and a waterproof film covering the windows.

The cover unit pertaining to the present invention covers the openings provided to the housing, each of which corresponding to one of the speakers. Therefore, the number of parts composing the electronic device is reduced, compared to a case where each of the openings is covered by using a separate unit.

In addition, when a single opening is formed in the housing with respect to multiple speakers, the cover unit suppresses the distortion of sound while covering the opening. Such an effect is realized by each of the windows of the cover unit facing a corresponding one of the multiple speakers (refer to the embodiment for further details).

As such, the cover unit pertaining to the present invention, when used as a waterproof cover for covering one or more openings that are formed in the housing of the electronic device with respect to a plurality of speakers, has an advantageous effect of suppressing at least one of (i) an increase in parts composing the electronic device; and (ii) an increase in the distortion of sound.

Here, the electronic device may be any device having multiple speakers disposed within the housing thereof, and may be, for instance, a PDA (personal digital assistant), a laptop or tablet-type PC (personal computer), a portable DVD player equipped with a liquid crystal display, a television image receiver, a radio receiver, an IC recorder, and etc.

(2) An arrangement may be made with respect to the cover unit pertaining to the present invention, wherein portions of the waterproof film respectively covering the windows are each caused to vibrate by sound waves produced by a corresponding one of the speakers, thereby transmitting sound to outside the housing.

According to this structure of the cover unit, it is clear that the portions of the waterproof film covering the windows (to be referred to hereinafter as "vibration units") vibrate and thereby transmit sounds produced by the speakers to outside the housing.

(3) An arrangement may be made with respect to the cover unit pertaining to the present invention, wherein the windows are circular in shape and are equivalent in size, and the frame member includes: an outer frame fixed to a rim portion of the waterproof film; and a partition that divides an area of the frame member surrounded by the outer frame so as to form the windows and that is fixed to the waterproof film.

According to this structure of the cover unit, the waterproof film is fixed to the outer frame and the partition of the frame member. Thus, unnecessary vibration of portions of the waterproof film other than the vibration units is effectively inhibited. Accordingly, the distortion of sound is appropriately suppressed.

(4) An arrangement may be made with respect to the cover unit pertaining to the present invention, wherein the frame member and the waterproof film have identical outlines, and the outline of the frame member and the outline of the waterproof film lie outside a range defined by two parallel virtual lines that are commonly tangent to two neighboring windows.

According to this structure of the cover unit, the outline of the frame member and the outline of the waterproof film lie outside a range defined by two parallel virtual lines that are commonly tangent to the two neighboring windows. That is, in other words, the frame member and the waterproof film at least exist within an area defined by the two windows and the two virtual lines that are commonly tangent to the two windows.

As such, the frame member has a comparatively large area, and the strength of the cover unit is thereby improved. This has the advantageous effect of reducing the risk of the cover unit being damaged, and thus the handling of the cover unit is facilitated. Further, the contact surface between the frame member and the waterproof film is provided with a comparatively large area, and the waterproof film is more securely fixed to the frame member. In consequence, the unnecessary vibration of portions of the waterproof film other than the vibration units is effectively inhibited, and the distortion of sound is appropriately suppressed.

(5) An arrangement may be made with respect to the cover unit pertaining to the present invention, wherein the frame member has a contact surface that is in contact with the waterproof film, and on a line passing through centers of two neighboring windows, a width of the contact surface located between the two windows is smaller than 200% but not smaller than 100% of a width of the contact surface located at the outer frame.

According to this structure of the cover unit, the width of the contact surface between the frame member and the waterproof film (adhesion width) is sufficient for secure adhesion, while the length of the adhesion width on a line passing through centers of two neighboring windows of the frame member is reduced. This is exemplary in cases where the space for disposing the cover unit (or the speakers) is limited (refer to the embodiment for more details). Note that the contact surface between the frame member and the waterproof film is where the frame member and the waterproof film are either in direct or indirect contact, and may be, for instance, an adhesion surface. Further, here, indirect contact between the frame member and the waterproof film as referred to in the above indicates a state where the frame member and the waterproof film are in contact via an adhesive film, for instance. The fixing of the frame member and the waterproof film may be conducted, for instance, by adhering the frame member and the waterproof film to each other by use of an adhesive agent, a double-sided adhesive film, and etc., or by sandwiching the waterproof film between two of the frame members.

(6) An arrangement may be made with respect to the cover unit pertaining to the present invention, wherein the openings are provided in one-to-one correspondence with the speakers, and each of the windows is greater in size compared to one of the openings facing the corresponding one of the speakers.

According to this structure of the cover unit, the windows are provided with a sufficient size for enclosing the one or more openings facing the corresponding one of the speakers. Thus, each of the vibration units is effectively vibrated by sound waves having passed through the corresponding one of the openings. In addition, the windows of the cover unit have circular shapes. Thus, when the portions of the waterproof film covering the windows are caused to vibrate, it is unlikely that the distortion of sound takes place.

(7) An arrangement may be made with respect to the cover unit pertaining to the present invention, wherein the electronic device includes an audio amplifier that amplifies audio signals and outputs the amplified audio signals to each of the speakers, and the amplified audio signals input to each of the speakers have the same amplitude and phase.

When the same audio signal is input to the multiple speakers, the speakers may be disposed closed to each other in a comparatively small space. In such a case, the one or more openings formed with respect to the multiple speakers are appropriately covered by the cover unit while it is ensured that the surface area of the cover unit is not excessively enlarged.

(8) An arrangement may be made with respect to the cover unit pertaining to the present invention such that the cover unit further comprises: a double-sided adhesive film having a same planar shape as a shape of the frame member, wherein the frame member and the double-sided adhesive film are in adhesion with the waterproof film, the waterproof film sandwiched between the frame member and the double-sided adhesive film.

According to this structure of the cover unit, the cover unit is readily adhered onto the electronic device by use of the double-sided adhesive film. Further, the provision of the double sided adhesive film having the same planar shape as the frame member has the advantageous effect of allowing the vibration of only the vibration units while suppressing the unnecessary vibration of portions of the waterproof film other than the vibration units.

(9) Another aspect of the present invention is an electronic device comprising: a housing having one or more openings formed therein; a plurality of speakers disposed within the housing, the speakers facing the one or more openings; and a cover unit preventing entry of water into the housing by covering the one or more openings, wherein the cover unit includes: a frame member having a plurality of windows disposed therein, the windows facing the speakers in one-to-one correspondence; and a waterproof film covering the windows.

The electronic device having the above-described structure yields the same technical effects as the cover unit described in (1) in the above. Note that further, at least one of the features and arrangements as described in (2) through (8) above may be applied to the electronic device.

(10) An arrangement may be made with respect to the electronic device pertaining to the present invention, wherein the one or more openings are provided in one-to-one correspondence with the speakers, the windows are circular in shape and are equivalent in size, an outer circumferential portion of a surface of each of the speakers, the surface facing a corresponding one of the one or more openings, is in close contact with an area of the housing surrounding the corresponding one of the one or more openings, and a space is defined by the surface of each of the speakers, the waterproof film covering the windows, and a wall defining an outer circumference of a corresponding one of the one or more openings.

According to this structure of the electronic device, a separate space is provided with respect to the surface of each of the speakers facing the corresponding one of the one or more openings. Hence, sound waves produced by a speaker corresponding to one opening does not readily reach a vibration unit corresponding to another opening. As such, the generation of undesirable vibrations is suppressed, and further, the distortion in sound is appropriately inhibited.

INDUSTRIAL APPLICABILITY

The cover unit pertaining to the present invention is applicable to and useful in electronic devices, such as mobile telephones and laptop-type personal computers, having multiple speakers disposed in the housings thereof.

REFERENCE SIGNS LIST

| | |
|---|---|
| 100 | portable information terminal |
| 110 | first housing |
| 111 | housing main body |
| 111a | rear side of housing |
| 111b | front side of housing |
| 112 | protection cover |
| 114 | receiver |
| 115 | display panel |
| 118 | slits |
| 120 | second housing |
| 124 | user operation unit |
| 140a, b | speakers |
| 153 | audio processing unit |
| 153a | amplifier |
| 180a, b | openings |
| 184 | partition |
| 200 | cover unit |
| 202 | double-sided adhesive film |
| 210 | waterproof film |
| 211a, b | vibration units |
| 212 | rim portion |

-continued

| | |
|---|---|
| 213 | boundary portion |
| 220 | frame member |
| 221a, b | windows |
| 223 | outer frame |
| 224 | partition |
| 226 | adhesive surface |
| 230 | double-sided adhesive film |
| 231, 241 | windows |
| 233, 243 | outer frames |
| 234, 244 | partitions |
| 240 | double-sided adhesive film |
| 260a, b | spaces |
| 300 | cover unit (comparative example) |
| 400 | cover unit (comparative example) |
| 411 | vibration unit |
| 500 | portable information terminal |
| 580 | opening |

The invention claimed is:

1. A cover unit that is for an electronic device including:

a housing having one or more openings formed therein; and a plurality of speakers disposed within the housing, the speakers facing the one or more openings, the cover unit preventing entry of water into the housing by covering the one or more openings and comprising:

a frame member having a plurality of windows disposed therein, the windows facing the speakers in one-to-one correspondence, wherein the windows are circular in shape and are equivalent in size; and a waterproof film covering the windows, wherein the waterproof film is provided as a single waterproof film covering the plurality of windows;

wherein the frame member includes an outer frame fixed to a rim portion of the waterproof film, and a partition that divides an area of the frame member surrounded by the outer frame so as to form the windows and that is fixed to the waterproof film, and wherein the frame member and the waterproof film have identical outlines, and the outline of the frame member and the outline of the waterproof film lie outside a range defined by two parallel virtual lines that are commonly tangent to two neighboring windows.

2. The cover unit of claim 1, wherein portions of the waterproof film respectively covering the windows are each caused to vibrate by sound waves produced by a corresponding one of the speakers, thereby transmitting sound to outside the housing.

3. The cover unit of claim 1, wherein the frame member has a contact surface that is in contact with the waterproof film, and on a line passing through centers of two neighboring windows, a width of the contact surface located between the two windows is smaller than 200% but not smaller than 100% of a width of the contact surface located at the outer frame.

4. The cover unit of claim 1, wherein the openings are provided in one-to-one correspondence with the speakers, and each of the windows is greater in size compared to one of the openings facing the corresponding one of the speakers.

5. The cover unit of claim 1, wherein the electronic device includes an audio amplifier that amplifies audio signals and outputs the amplified audio signals to each of the speakers, and the amplified audio signals input to each of the speakers have the same amplitude and phase.

6. The cover unit of claim 1 further comprising:

a double-sided adhesive film having a same planar shape as a shape of the frame member, wherein the frame member and the double-sided adhesive film are in adhesion with the waterproof film, the waterproof film sandwiched between the frame member and the double-sided adhesive film.

7. The cover unit of claim 1, wherein the housing of the electronic device has two or more openings formed therein.

8. An electronic device comprising:

a housing having one or more openings formed therein;

a plurality of speakers disposed within the housing, the speakers facing the one or more openings; and a cover unit preventing entry of water into the housing by covering the one or more openings, wherein the cover unit includes:

a frame member having a plurality of windows disposed therein, the windows facing the speakers in one-to-one correspondence, wherein the windows are circular in shape and are equivalent in size; and a waterproof film covering the windows, wherein the waterproof film is provided as a single waterproof film covering the plurality of windows;

wherein the frame member includes an outer frame fixed to a rim portion of the waterproof film, and a partition that divides an area of the frame member surrounded by the outer frame so as to form the windows and that is fixed to the waterproof film, and wherein the frame member and the waterproof film have identical outlines, and the outline of the frame member and the outline of the waterproof film lie outside a range defined by two parallel virtual lines that are commonly tangent to two neighboring windows.

9. The electronic device of claim 8, wherein the one or more openings are provided in one-to-one correspondence with the speakers, an outer circumferential portion of a surface of each of the speakers, the surface facing a corresponding one of the one or more openings, is in close contact with an area of the housing surrounding the corresponding one of the one or more openings, and a space is defined by the surface of each of the speakers, the waterproof film covering the windows, and a wall defining an outer circumference of a corresponding one of the one or more openings.

* * * * *